US011192750B2

(12) United States Patent
Zhao

(10) Patent No.: US 11,192,750 B2
(45) Date of Patent: Dec. 7, 2021

(54) HANDRAIL ASSEMBLY, CAR AND ELEVATOR

(71) Applicant: Otis Elevator Company, Farmington, CT (US)

(72) Inventor: PengFei Zhao, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 173 days.

(21) Appl. No.: 16/719,382

(22) Filed: Dec. 18, 2019

(65) Prior Publication Data

US 2020/0207579 A1 Jul. 2, 2020

(30) Foreign Application Priority Data

Dec. 26, 2018 (CN) ..... 201811600092.1

(51) Int. Cl.
*B66B 5/00* (2006.01)
*B66B 11/02* (2006.01)

(52) U.S. Cl.
CPC ..... *B66B 5/0081* (2013.01); *B66B 11/0246* (2013.01)

(58) Field of Classification Search
CPC . B66B 5/0081; B66B 5/0087; B66B 11/0246; B66B 5/0062; B66B 11/0226
See application file for complete search history.

(56) References Cited

U.S. PATENT DOCUMENTS 6,543,584 B1 * 4/2003 Miyakoshi ..... B66B 5/0081 187/401
6,830,127 B2 * 12/2004 Johnson ..... E02D 29/12 182/113
8,365,870 B2 * 2/2013 Sirigu ..... B66B 13/22 187/306
10,029,885 B2 * 7/2018 D'Apice ..... B66B 5/0081
10,233,054 B2 * 3/2019 Ishiguro ..... E05F 1/12
2005/0230194 A1 * 10/2005 Nakamura ..... B66B 5/0081 187/401

(Continued)

FOREIGN PATENT DOCUMENTS

CN 102897617 A 1/2013
CN 204185053 U 3/2015

(Continued)

*Primary Examiner* — Michael A Riegelman
(74) *Attorney, Agent, or Firm* — Cantor Colburn LLP

(57) ABSTRACT

A handrail assembly, a car and an elevator. The handrail assembly includes a fixing portion and a moving portion, the fixing portion comprises a plurality of first vertical posts arranged in a vertical direction, wherein the first vertical posts are configured to be hollow; the moving portion comprises: a plurality of lifting portions each comprising a plurality of second vertical posts movable into the first vertical posts and horizontal posts attached between the second vertical posts, wherein each lifting portion is configured to move at least between the extended position and the retracted position, the horizontal post is adjacent to the fixing portion when in the retracted position, and the horizontal post is away from the fixing portion when in the extended position; a limiting component to make each lifting portion ascend or descend in sequence in the vertical direction; and a sensing mechanism.

14 Claims, 6 Drawing Sheets

(56) References Cited

U.S. PATENT DOCUMENTS

| | | | | |
|---|---|---|---|---|
| 2008/0217113 | A1* | 9/2008 | Bonatre | B66B 5/0081 187/401 |
| 2008/0245619 | A1* | 10/2008 | Monzon-Simon | B66B 5/0062 187/393 |
| 2012/0164928 | A1* | 6/2012 | Wuest | B66B 11/024 454/68 |
| 2018/0002139 | A1* | 1/2018 | Stepp | B66B 11/0226 |
| 2018/0362298 | A1* | 12/2018 | Roussel | B66B 5/0081 |
| 2019/0256323 | A1* | 8/2019 | Schuler | B66B 11/0226 |
| 2020/0207579 | A1* | 7/2020 | Zhao | B66B 11/0246 |

FOREIGN PATENT DOCUMENTS

| | | | |
|---|---|---|---|
| EP | 1481936 | A1 | 12/2004 |
| EP | 2138440 | A1 | 12/2009 |
| FR | 2866665 | A1 | 8/2005 |
| FR | 2891820 | A1 | 4/2007 |
| JP | 2010058861 | A | 3/2010 |
| NL | 1030867 | C2 | 7/2007 |
| WO | 2012024930 | A1 | 3/2012 |
| WO | 2018078762 | A1 | 5/2018 |
| WO | 2018087381 | A1 | 5/2018 |
| WO | 2018095741 | A1 | 5/2018 |

* cited by examiner

HANDRAIL ASSEMBLY, CAR AND ELEVATOR

FOREIGN PRIORITY

This application claims priority to Chinese Patent Application No. 201811600092.1, filed Dec. 26, 2018, and all the benefits accruing therefrom under 35 U.S.C. § 119, the contents of which in its entirety are herein incorporated by reference.

FIELD OF THE INVENTION

The present application relates to the field of car protection structures. More specifically, the present application relates to a handrail assembly for a car that can selectively extend to provide safety protection on the top of the car. The present application further relates to a car comprising the above-described handrail assembly and an elevator for the car.

BACKGROUND OF THE INVENTION

During elevator maintenance, maintenance personnel usually need to perform maintenance operations on top of the car. In order to ensure the personal safety of the maintenance personnel, the top of the car is usually provided with a handrail to prevent the maintenance personnel from falling off. The handrail needs to reach a certain height for safety reasons. For example, the handrail needs to reach a height above 1100 mm.

However, the space on the top of the car is usually limited, and there is a need to save space for mounting other equipment. Accordingly, there is a continuing need for a new handrail assembly, car, and elevator, and it is desirable that the solution can further improve the space usage efficiency of the handrail assembly.

SUMMARY OF THE INVENTION

The object of one aspect of the present application is to provide a handrail assembly that can selectively retracts or extends. The object of another aspect of the present application is to provide a car comprising the handrail assembly described above. The object of yet another aspect of the present application is to provide an elevator comprising the car or handrail assembly described above.

The object of the present application is achieved by the following technical solution: a handrail assembly for a car, comprising: a fixing portion comprising a plurality of first vertical posts arranged in a vertical direction, wherein the first vertical posts are configured to be hollow; a moving portion comprising: a plurality of lifting portions each comprising a plurality of second vertical posts movable into the first vertical post and horizontal posts attached between the second vertical posts, wherein each lifting portion is configured to be moveable at least between an extended position and a retracted position, the horizontal post is adjacent to the fixing portion when in the retracted position, and the horizontal post is away from the fixing portion when in the extended position; a limiting component to make each lifting portion ascends or descends in sequence in the vertical direction; and a sensing mechanism comprising a safety lock attached to the fixing portion and an insert attached to the moving portion, wherein the insert is inserted into the safety lock when in the retracted position, and the insert is separated from the safety lock when in the extended position.

In the handrail assembly described above, optionally, the limiting component comprises a tab attached to one of the lifting portions, wherein the tab extends above the adjacent lifting portion, such that the adjacent lifting portion cannot ascend when the one of the lifting portions has not ascended, and the one of the lifting portions cannot descend when the adjacent lifting portion has not descended.

In the handrail assembly described above, optionally, the tabs are arranged such that each lifting portion can ascend in sequence in a clockwise or counterclockwise order, and then descend in sequence in a counterclockwise or clockwise order.

In the handrail assembly described above, optionally, the insert is disposed on the lifting portion that firstly ascends.

In the handrail assembly described above, optionally, the first vertical posts are provided with grooves extending in the vertical direction, first fixing portions and second fixing portions are disposed along the grooves, screws extend through the grooves and are rotatably attached to the second vertical posts, and are selectively supported by the first fixing portions or the second fixing portions, wherein the screws are configured to drive the second vertical posts to move between the first fixing portions and the second fixing portions along the grooves.

In the handrail assembly described above, optionally, nuts are attached to the second vertical posts and the screws are configured to fit with the nuts.

In the handrail assembly described above, optionally, the grooves are configured such that the moving portions are in the retracted position when the screws are supported by the first fixing portions, and the moving portions are in the extended position when the screws are supported by the second fixing portions.

In the handrail assembly described above, optionally, one ends of the screws are provided with handles to enable the screws to be manually rotated relative to the nuts.

In the handrail assembly described above, optionally, further comprising an opening in a horizontal direction.

In the handrail assembly described above, optionally, the handrail assembly overall has a first height of less than about 945 mm when in the retracted position.

In the handrail assembly described above, optionally, the handrail assembly overall has a second height of greater than about 1100 mm when in the extended position.

A car comprising the handrail assembly described above, wherein the car is configured to be stationary when the insert is separated from the safety lock.

In the car described above, optionally, the handrail assembly is disposed on the top of the car, and the handrail assembly is disposed around at least a part of the car perimeter.

An elevator comprising the handrail assembly described above, or comprising the car described above.

The handrail assembly, the car and the elevator of the present application have the advantages of being simple in structure, easy to manufacture, convenient to use and the like, and the height of the handrail assembly can be conveniently adjusted so as to provide proper safety protection.

BRIEF DESCRIPTION OF THE DRAWINGS

The present application will be described in further details below in conjunction with the accompanying drawings and the preferred embodiments, but those skilled in the art will appreciate that these figures are depicted for the purpose of illustrating the preferred embodiments only and are therefore not to be construed as limiting the scope of the present application. In addition, unless specifically indicated, the accompany drawings are only intended to conceptually illustrate the composition or configuration of the described objects and may contain exaggerated display, and the drawings are not necessarily drawn to scale.

DETAILED DESCRIPTION OF THE EMBODIMENTS

Figure 1:
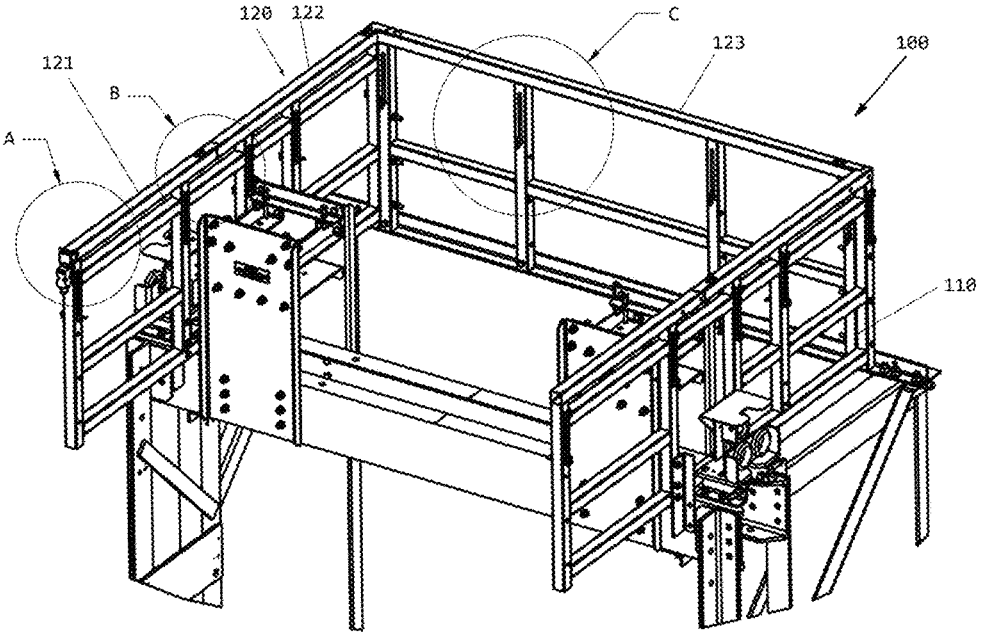
FIG. 1 is a perspective view of one embodiment of a handrail assembly of the present application.

Preferred embodiments of the present application will be described in details below with reference to the accompanying drawings. It will be appreciated by those skilled in the art that these descriptions are merely descriptive, exemplary, and should not be construed as limiting the scope of the present application.

Firstly, it should be noted that the orientation terms of top, bottom, upward, downward, etc. referred to herein are defined relative to the directions in the various drawings, which are relative concepts, and thus can vary depending on the different locations in which they are located and the different states of utilization. Accordingly, these or other orientation terms shall not to be construed as limiting terms.

Furthermore, it should also be noted that for any single technical feature described or implied in the embodiments herein, or any single technical feature shown or implied in the drawings, it is possible to continue combining between these technical features (or equivalents thereof), so as to obtain other embodiments of the present application that are not directly mentioned herein.

It should be noted that like reference numerals refer to the same or substantially the same components in different drawings.

FIG. 1 is a perspective view of one embodiment of a handrail assembly of the present application. Wherein the handrail assembly 100 for the car comprises a fixing portion 110 and a moving portion 120. The fixing portion 110 comprises a plurality of first vertical posts disposed in a vertical direction, wherein the first vertical posts are configured to be hollow. The moving portion 120 comprises a plurality of lifting portions 121, 122, 123, etc. The plurality of lifting portions each comprise a plurality of second vertical posts movable into the first vertical posts and horizontal posts attaching between the second vertical posts, wherein each lifting portion is configured to moveable at least between an extended position and a retracted position, the horizontal post is adjacent to the fixing portion when in the retracted position, and the horizontal post is away from the fixing portion when in the extended position.

The "vertical direction" as mentioned herein refers to the direction of gravity or the direction along which the elevator car moves. Correspondingly, the "horizontal direction" as mentioned herein refers to a direction perpendicular to the vertical direction, i.e., a direction in the horizontal plane. As used herein, the description of "vertical" or "horizontal" means to be in the vertical direction or in the horizontal direction.

The fixing portion 110 may comprise a plurality of first vertical posts disposed in parallel to each other, so as to be arranged around a certain space which preferably may be the space on the top of the elevator car. And an opening in the horizontal direction may be provided on the fixing portion, such that the maintenance personnel can enter the space surrounded by the fixing portion 110 through the opening. Each of the first vertical posts in the fixing portion 110 may be fixed to the top of the car, or horizontal posts may be provided between each of the first vertical posts so as to maintain the stability of the fixing portion 110 itself.

The moving portion 120 may also comprise a plurality of second vertical posts extending in the vertical direction, and each second vertical post is connected by one or more horizontal posts. The moving portion 120 is divided into a plurality of lifting portions. In the illustrated embodiment, each lifting portion has at least two second vertical posts and a horizontal post attached between the second vertical posts.

The interior of the plurality of first vertical posts may be configured to be hollow, and the size of the interior of the first vertical post is configured such that the second vertical post can extend into the first vertical post and can enter or exit the first vertical post. In the illustrated embodiment, the interior of all first vertical posts are configured to be hollow and are suitable to house the second vertical posts. However, according to actual needs, some of the first vertical posts may not have hollow structure. Correspondingly, no second vertical post is disposed above such first vertical posts.

Some components on the handrail assembly of the present application will be described in details below in conjunction with FIGS. 2-6.

Figure 2:
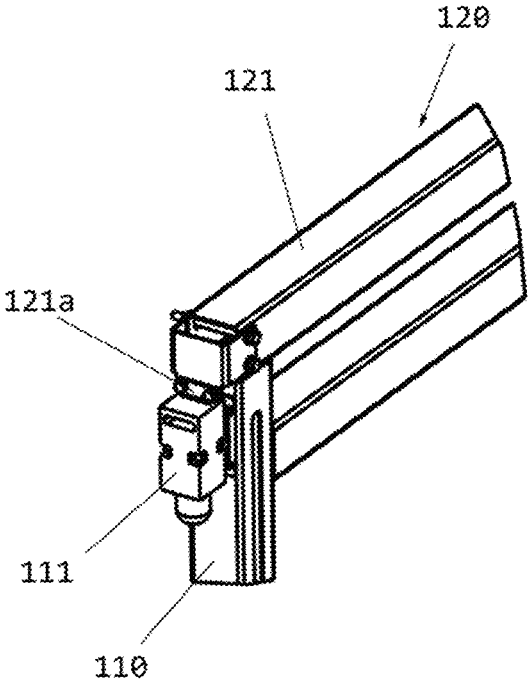
FIG. 2 is a partially enlarged view of the embodiment shown in FIG. 1.

FIG. 2 is a partially enlarged view of the embodiment shown in FIG. 1, which shows in details the structure of the "A" portion in FIG. 1. Wherein the sensing mechanism according to an embodiment of the present application comprises a safety lock 111 attached onto the fixing portion 110 and an insert 121*a* attached onto the moving portion 120. The sensing mechanism is configured to sense whether the moving portion 120 has started to move away from the fixing portion 110. Wherein, the insert 121*a* is inserted into the safety lock 111 when in the retracted position, and the insert 121*a* is separated from the safety lock 111 when in the extended position.

The safety lock 111 may contain an element for sensing the insert 121*a*, so as to sense whether the insert 121*a* has been inserted. The safety lock 111 may also be electrically connected with an elevator control unit not shown, so as to send a signal of the insert 121*a* being inserted or leaving to the elevator control unit. The elevator control unit then performs corresponding operations according to that signal. The specific operation will be described in details below.

In the illustrated embodiment, the insert 121*a* is attached to the left-most lifting portion 121 in FIG. 1. Thus, when the lifting portion 121 ascends into the extended position, the insert 121*a* will then ascend and separate from the safety lock 111. When the lifting portion 121 descends into the retracted position, the insert 121*a* will be inserted into the safety lock 111.

In one embodiment, the insert 121*a* may be a metal sheet, or may be of a shape other than the sheet-like shape, for example, a bar, a protrusion, or the like. The safety lock 111 may be configured to sense the insertion of a metal object, or sense in any other suitable sensing manner.

Figure 3:
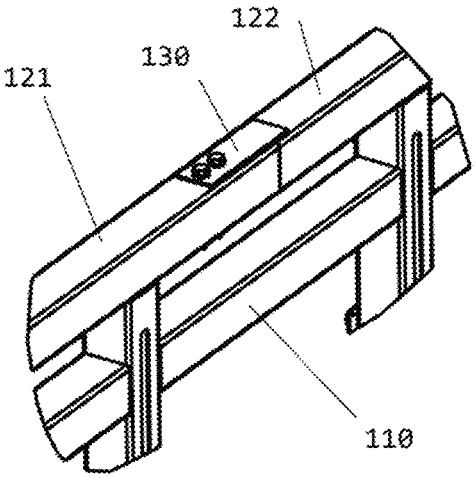
FIG. 3 is another partially enlarged view of the embodiment shown in FIG. 1.

FIG. 3 is another partially enlarged view of the embodiment shown in FIG. 1, which shows in details the structure of the "B" portion in FIG. 1. Wherein a limiting component is further provided on the handrail assembly according to the present application, so that each lifting portion ascends or descends in the vertical direction in sequence. For example, in the illustrated embodiment, the limiting component comprises a tab 130 attached to the lifting portion 121, wherein the tab 130 extends above the adjacent lifting portion 122 such that when the lifting portion 121 has not ascended, the adjacent lifting portion 122 cannot ascend, and when the adjacent lifting portion 122 has not descended, the lifting portion 121 cannot descend. The tab 130 may be secured onto the lifting portion 121 by one or more bolts, and a part of the tab 130 extends away from the lifting portion 121 and is located above the adjacent lifting portion 122.

Similarly, the adjacent lifting portion 122 and the subsequent lifting portions may also be provided therebetween with tab structures as shown in FIG. 3, and the tabs are arranged such that each lifting portion can ascend in a clockwise or counterclockwise order in sequence and then descend in a counter-clockwise or clockwise order in sequence. The above sequence may be set according to actual needs, or different ascending or descending order may be achieved by employing different arrangements.

As can be learnt in conjunction with FIG. 1, the insert 121*a* is disposed above the lifting portion that would firstly ascend (i.e., the lifting portion 121). Thus, when the lifting portion 121 reaches the extended position, the sensing mechanism would sense that the moving portion 120 has moved at least partially away from the fixing portion 110 and towards the extended position, and thus corresponding operation may be taken.

Although the tab 130 is configured as a sheet-like structure in the illustrated embodiment, it is readily understood that structures of other shapes may be employed according to actual needs.

Figure 4:
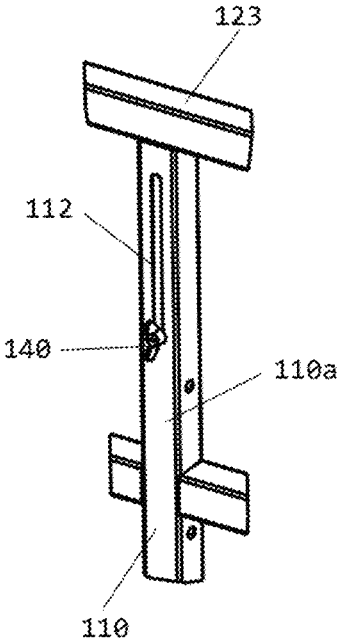
FIG. 4 is yet another partially enlarged view of the embodiment shown in FIG. 1.
Figure 5:
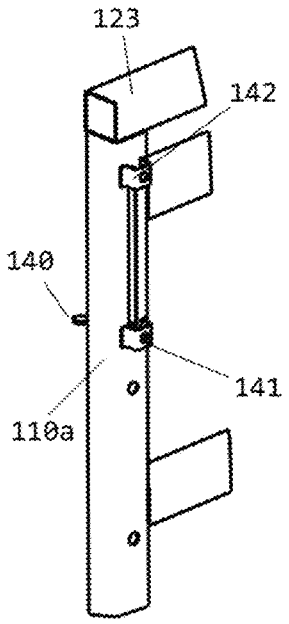
FIG. 5 is a view of another aspect of the portion shown in FIG. 4.
Figure 6:
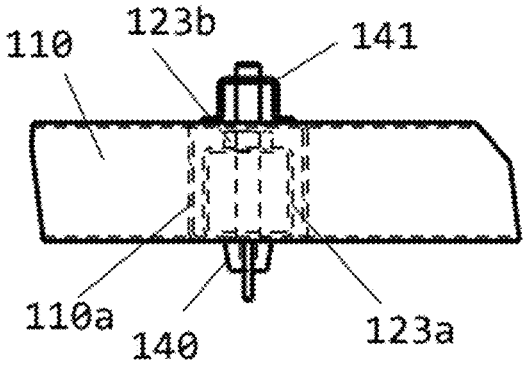
FIG. 6 is a cross-sectional view of the portion shown in FIG. 4.

FIG. 4 is yet another partially enlarged view of the embodiment shown in FIG. 1, FIG. 5 is a view of another aspect of the portion shown in FIG. 4, and FIG. 6 is a cross-sectional view of the portion shown in FIG. 4. FIGS. 4 to 6 show in details the structure of the "C" portion in FIG. 1. Wherein the first vertical post 110*a* is provided with a groove 112 extending in the vertical direction, a first fixing portion 141 and a second fixing portion 142 are disposed along the groove 112, and a screw 140 extends through the groove 112 and is rotatably attached to the second vertical post 123*a* and selectively supported by either the first fixing portion 141 or the second fixing portion 142, wherein the screw 140 is configured to actuate the second vertical post 123*a* to move between the first fixing portion 141 and the second fixing portion 142 along the groove 112.

As shown in FIG. 6, a nut 123*b* is attached onto the second vertical post 123*a*, and the screw 140 is configured to fit with the nut 123*b*. The nut 123*b* and the second vertical post 123*a* are integrally located inside the first vertical post 110*a*. Wherein the nut 123*b* may be fixed relative to the second vertical post 123*a* in any suitable manner, comprising but not limited to welding, gluing, and the like.

The size and position of groove 112 is configured such that when the screw 140 is supported by the first fixing portion 141, the moving portion 120 (specifically the lifting portion corresponding to the groove 120 in the figures, i.e., the lifting portion 123 in FIG. 1) is in the retracted position, and when the screw 140 is supported by the second fixing portion 142, the moving portion 120 is in the extended position.

One end of the screw 140 is provided with a handle, so as to enable the screw 140 to be manually rotated relative to the nut 123*b*. The handle may also be a fin attached to or integrally formed with the screw 140. By rotating the screw 140, the screw 140 may move relative to the nut 123*b* in the direction of the rotational axis, thus being able to selectively separate from or attach to the first fixing portion 141 or the second fixing portion 142. When the screw 140 is separated from both the first fixing portion 141 and the second fixing portion 142, the lifting portion can ascend or descend without obstruction. At this point, the screw 140 may ascend or descend along the groove 112, and the length of the groove 112 limits the moving position of the screw 140. When the screw 140 is in contact with and supported by one of the first fixing portion 141 or the second fixing portion 142, the screw 140 can function as positioning, so that the lifting portion can be positioned at the location defined by one of the first fixing portion 141 or the second fixing portion 142.

The screw 140 may be simply supported by one of the first fixing portion 141 or the second fixing portion 142. The first fixing portion 141 or the second fixing portion 142 may be provided with positioning structures such as supporting portions, rods, holes, threads, etc. for supporting the screw 140.

Figure 7:
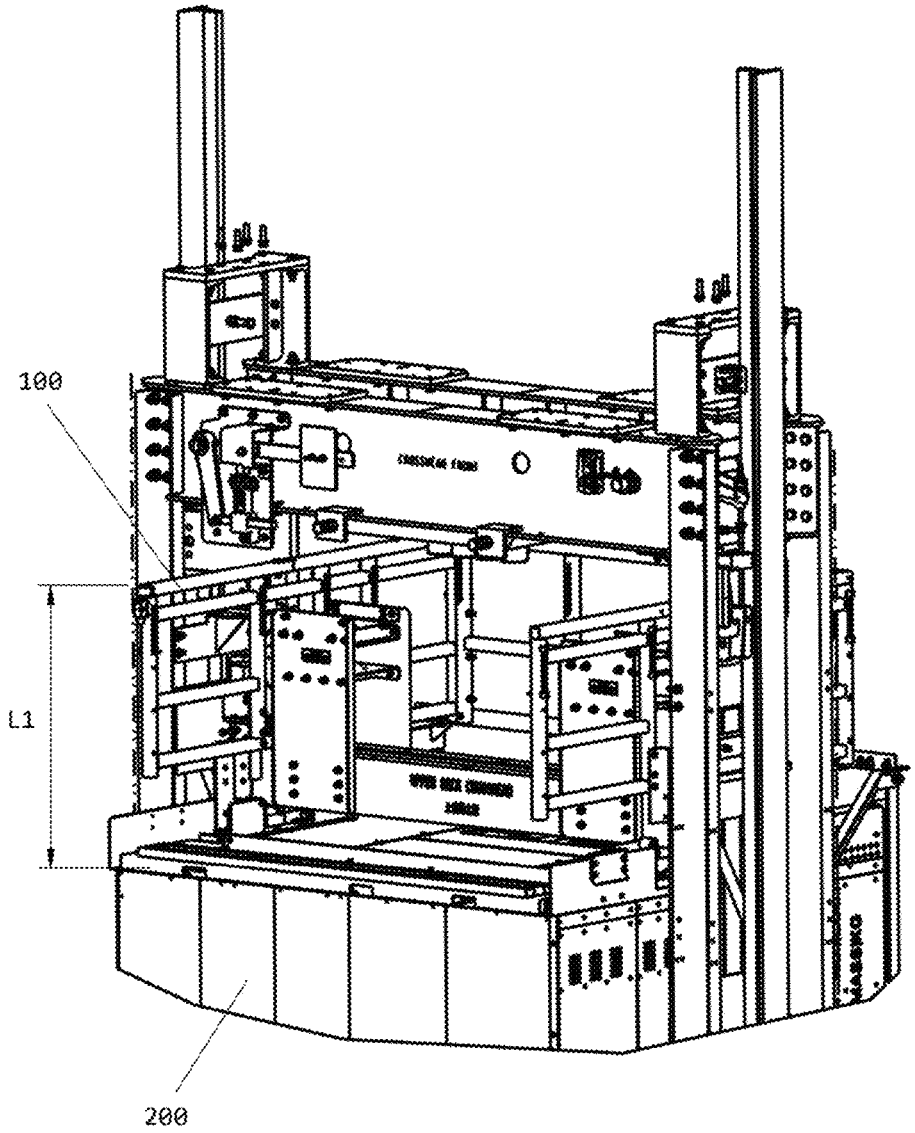
FIG. 7 is a perspective view of the elevator of the present application when the handrail assembly is in the retracted position.

FIG. 7 is a perspective view of the elevator of the present application when the handrail assembly is in the retracted position. When in the retracted position, the handrail assembly 100 overall has a first height L1 of less than about 945 mm.

As shown, the handrail assembly 100 according to the present application is disposed on top of the car 200, and the handrail assembly 100 is arranged around at least a part of the perimeter of the car 200. For example, the handrail assembly 100 may be disposed around three sides on the top of the car 200 and no handrail assembly is disposed on another side on the top of the car 200, so as to form an opening for maintenance personnel to access the top of the car 200.

Figure 8:
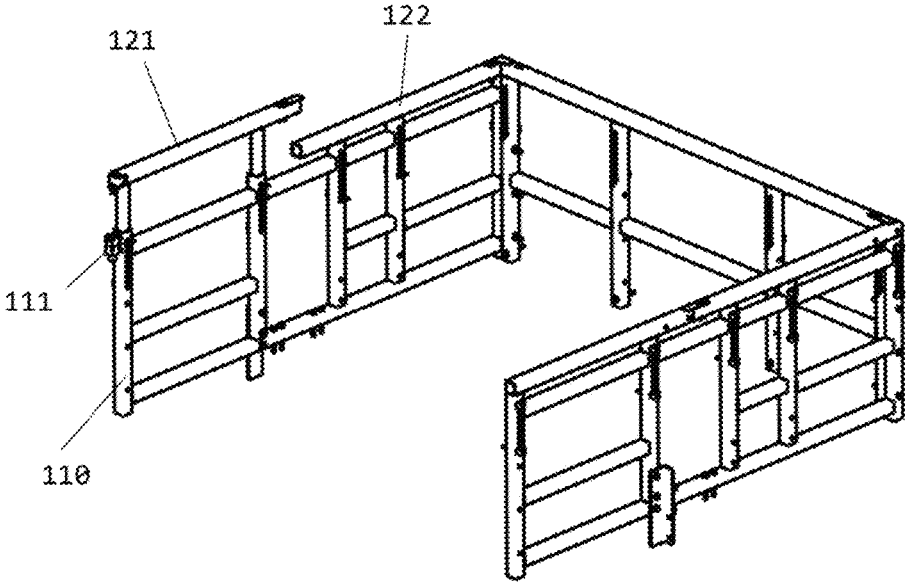
FIG. 8 is a perspective view of the embodiment shown in FIG. 1 during extension.

FIG. 8 is a perspective view of the embodiment of FIG. 1 during extension. Wherein the lifting portion 121 in the handrail assembly 100 has ascended to the extended position, and other lifting portions are still in the retracted position. At this point, the limiting component or tab on the lift portion 121 has been separated from the lifting portion 122, and thus the lifting portion 122 may ascend in the vertical direction without limitation in subsequent operations. It will be readily understood that at this point, the safety lock 111 has also been separated from the insert, and thus, the elevator control system can receive a signal indicating that the insert has separated issued by the safety lock 111, thereby determining that the lifting portion 121 has left the retracted position. It will be readily understood that the lifting portion 121 will move away from the retracted position only when being operated manually by the maintenance personnel, and thus, the elevator control system will determine that the maintenance personnel is on the top of the car. At this point, the elevator control system will not allow further movement of the car or elevator to ensure safety of the maintenance personnel. The elevator control system would allow further subsequent movement of the car and elevator before the lifting portion 121 is lowered back into the retracted position and the safety lock 111 detects the insertion of the insert.

In the illustrated embodiment, each lifting portion generally ascends from the retracted position to the extended position in a clockwise sequence, and generally descends from the extended position back into the retracted position in a counterclockwise sequence.

Figure 9:
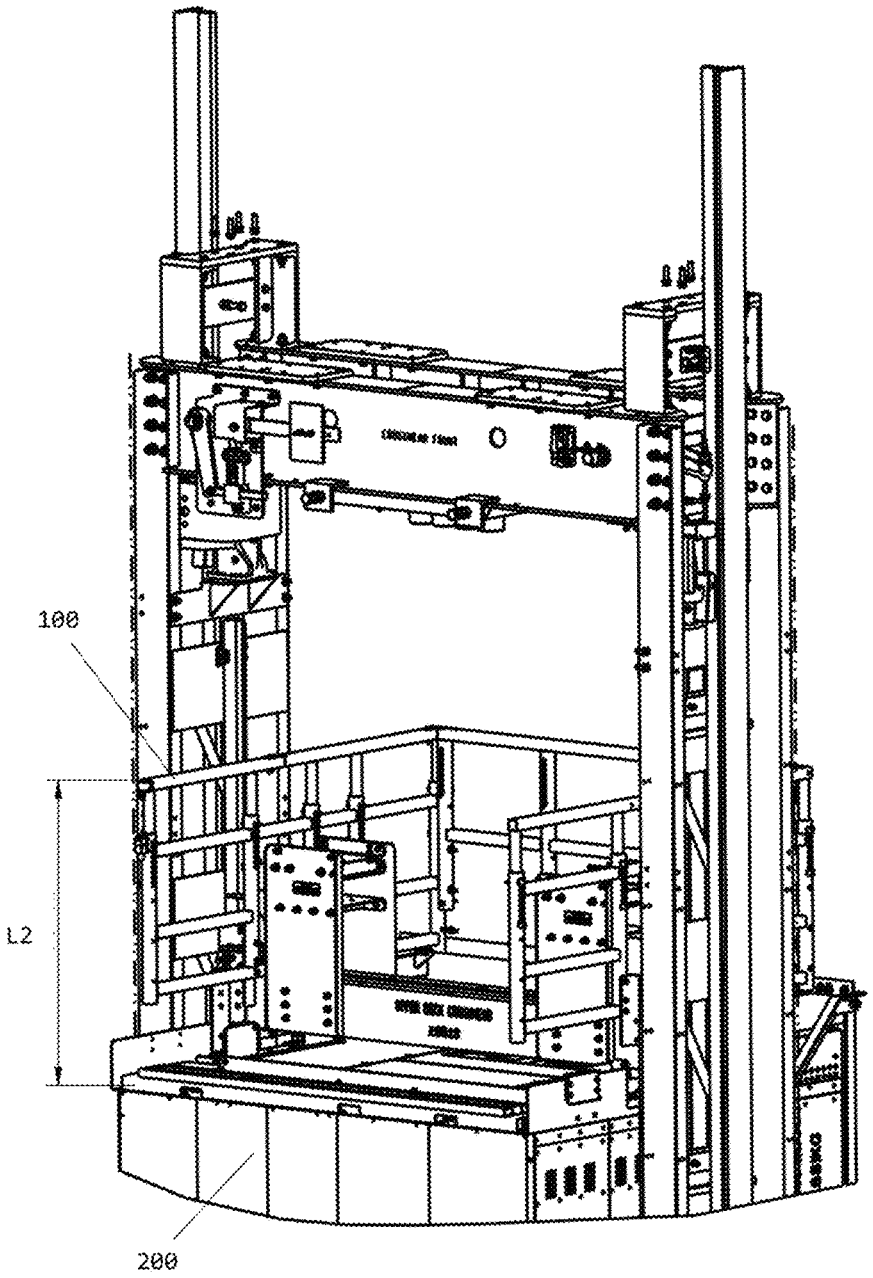
FIG. 9 is a perspective view of the embodiment of FIG. 7 when the handrail assembly is in the extended position.

FIG. 9 is a perspective view of the embodiment shown in FIG. 7 when the handrail assembly is in the extended position. When in the extended position, the handrail assembly 100 overall has a second height L2 greater than about 1100 mm. At this point, the height of the handrail assembly 100 meets the requirements of the enforced safety standard, and thus the safety of maintenance personnel operating on the car 200 can be ensured. Therefore, the handrail assembly 100 according to the present application can extend or retract according to actual needs, so that safety protection in accordance with the enforced standard is provided in limited space, and the maintenance efficiency of the elevator is effectively improved.

The present application also relates to a car 200 that comprises the handrail assembly 100 as described in accordance with various embodiments above. The handrail assembly 100 can be arranged on top of the car 200, and the top of the car 200 can also be provided with other devices or equipment. The car 200 may be lifted by a telescoping device located at the bottom of the car 200 during maintenance. For example, in the state shown in FIG. 7, the telescoping device is in extending state, and in the state shown in FIG. 9, the telescoping device is in retracted state.

The present application also relates to an elevator that comprises the handrail assembly described above or the car described above.

This written description discloses the present application with reference to the accompanying drawings, and also enables those skilled in the art to practice the present application, including making and employing any devices or systems, selecting suitable materials, and applying any incorporated methods. The scope of the present application is defined by the claimed technical solutions and comprises other instances that occur to those skilled in the art. Such other instances are intended to be within the scope of protection determined by the technical solutions claimed by the present application, as long as such other instances comprise structural elements that do not differ from the literal language of the claimed technical solutions, or such other instances comprise equivalent structural elements with no substantial difference from the literal language of the claimed technical solutions.

What is claimed is:

1. A handrail assembly for a car characterized in that it comprises:

a fixing portion comprising a plurality of first vertical posts arranged in a vertical direction, wherein the first vertical posts are configured to be hollow;

a moving portion comprising:

a plurality of lifting portions each comprising a plurality of second vertical posts movable into the first vertical posts and horizontal posts attached between the second vertical posts, wherein each lifting portion is configured to be moveable at least between an extended position and a retracted position, and the horizontal post is adjacent to the fixing portion when in the retracted position, and the horizontal post is away from the fixing portion when in the extended position;

a limiting component to make each lifting portion ascends or descends in sequence in the vertical direction; and a sensing mechanism comprising a safety lock attached to the fixing portion and an insert attached to the moving portion, wherein the insert is inserted into the safety lock when in the retracted position, and the insert is separated from the safety lock when in the extended position.

2. The handrail assembly of claim 1, characterized in that the limiting component comprises a tab attached to one of the lifting portions, wherein the tab extends above the adjacent lifting portion, such that the adjacent lifting portion cannot ascend when the one of the lifting portions has not ascended, and the one of the lifting portions cannot descend when the adjacent lifting portion has not descended.

3. The handrail assembly of claim 2, characterized in that the tabs are arranged such that each lifting portion can ascend in sequence in a clockwise or counterclockwise order, and then descend in sequence in a counterclockwise or clockwise order.

4. The handrail assembly of claim 3, characterized in that the insert is disposed on the lifting portion that firstly ascends.

5. The handrail assembly of claim 1, characterized in that the first vertical posts are provided with grooves extending in the vertical direction, first fixing portions and a second fixing portions are disposed along the grooves, screws extend through the grooves and are rotatably attached to the second vertical posts and selectively supported by the first fixing portions or the second fixing portions, wherein the screws are configured to actuate the second vertical posts to move between the first fixing portions and the second fixing portions along the grooves.

6. The handrail assembly of claim 5, characterized in that nuts are attached to the second vertical posts and the screws are configured to fit with the nuts.

7. The handrail assembly of claim 6, characterized in that the grooves are configured such that the moving portions are in the retracted position when the screws are supported by the first fixing portions, and the moving portions are in the extended position when the screws are supported by the second fixing portions.

8. The handrail assembly of claim 6, characterized in that one ends of the screws are with handles to enable the screws to be manually rotated relative to the nuts.

9. The handrail assembly of claim 1, characterized in that further comprising an opening in the horizontal direction.

10. The handrail assembly of claim 1, characterized in that the handrail assembly overall has a first height of less than about 945 mm when in the retracted position.

11. The handrail assembly of claim 1, characterized in that the handrail assembly overall has a second height of greater than about 1100 mm when in the extended position.

12. A car characterized in that it comprises the handrail assembly of claim 1, wherein the car is configured to be stationary when the insert is separated from the safety lock.

13. The car of claim 12, characterized in that the handrail assembly is disposed on the top of the car, and the handrail assembly is arranged around at least a part of the car perimeter.

14. An elevator characterized in that it comprises the car of claim 12.

* * * * *